United States Patent [19]

Belmont

[11] 3,979,123

[45] Sept. 7, 1976

[54] GOLF CLUB HEADS AND PROCESS

[76] Inventor: Peter A. Belmont, 7 White Birch Ridge, Weston, Conn. 06608

[22] Filed: Apr. 2, 1975

[21] Appl. No.: 564,426

Related U.S. Application Data

[63] Continuation-in-part of Ser. No. 419,797, Nov. 28, 1973, Pat. No. 3,897,066.

[52] U.S. Cl. ..... 273/171

[51] Int. Cl.[2] ..... A63B 53/08

[58] Field of Search ..... 273/77 R, 78, 167–175

[56] References Cited

UNITED STATES PATENTS

| | | | |
|---|---|---|---|
| 1,091,231 | 3/1914 | Millar | 273/169 |
| 1,133,129 | 3/1915 | Govan | 273/171 |
| 1,167,387 | 1/1916 | Daniel | 273/171 |
| 1,289,192 | 12/1918 | Klin | 273/169 |
| 1,306,029 | 6/1919 | Robertson | 273/171 |
| 1,497,578 | 6/1924 | Mothersele | 273/172 |
| 1,840,924 | 1/1932 | Tucker | 273/171 X |
| 2,214,356 | 9/1940 | Wettlaufer | 273/171 X |
| 2,360,364 | 10/1944 | Reach | 273/171 |
| 3,212,783 | 10/1965 | Bradley et al. | 273/171 |
| 3,466,047 | 9/1969 | Rodia et al. | 273/171 |
| 3,606,327 | 9/1971 | Gorman | 273/171 X |
| 3,610,630 | 10/1971 | Glover | 273/171 |
| 3,761,095 | 9/1973 | Thompson | 273/174 |

FOREIGN PATENTS OR APPLICATIONS

| | | | |
|---|---|---|---|
| 440,379 | 12/1935 | United Kingdom | 273/171 |
| 439,187 | 12/1935 | United Kingdom | 273/171 |

OTHER PUBLICATIONS

"Golf Digest," Feb. 1967, p. 92.

*Primary Examiner*—Richard J. Apley
*Attorney, Agent, or Firm*—Thomas L. Tully

[57] ABSTRACT

Wooden head for a golf club comprising a wooden body having a top surface, an undersurface carrying a soleplate, a rear surface and a face surface carrying a faceplate adapted to strike a golf ball during use of the golf club. The weight and balance of the head is adjustable by varying the weight of closure means applied to capsules cemented within the wooden body. The capsules extend parallel to each other and to the swing axis of the head and are positioned towards the undersurface and rear surface of the wooden body, the rear surface of said capsules being provided with threaded openings into which closure means of different weights can be screwed for purposes of varying the weight of material therein and adjusting the weight and balance of the club.

6 Claims, 4 Drawing Figures

GOLF CLUB HEADS AND PROCESS

The present application is a continuation-in-part of copending application, Ser. No. 419,797, filed Nov. 28, 1973, now U.S. Pat. No. 3,897,066.

The present invention relates to novel wooden heads for golf clubs which virtually assure more consistency of performance and greater distance and which may be adjusted with respect to their weight and the distribution thereof to suit them to the needs of the user. A variety of adjustably-weighted clubs have been proposed over the years in an effort to suit the weight and weight distribution of the club to the user. Primarily such prior proposals relate to various methods for positioned weights at the core or center of gravity of the club head or towards the face thereof, such weights generally being removable from the undersurface of the head through the soleplate. Such methods have the disadvantage of providing excess weight at the face surface of the club head causing the head to dip into the ball during the swing and reducing the loft or altitude imparted to the ball. Also, such methods generally involve a single central means for varying the weight of the club head, which means does not permit weight adjustment towards either the heel or the toe of the club head, as desired, and which modifies the swing balance or feel of the club.

Other proposals have been made to provide movable weights within a club head and adapted to contact the interior surface of the faceplate during contact with the ball. Such proposals also have the disadvantage of locating the weight distribution too far forward of the center of gravity of the club head, causing the face surface to dip into the ball and reducing the loft of the shot.

It is the principal object of the present invention to provide a novel golf club head construction which permits alteration of the weight and the weight distribution of the club head without modifying the swing balance or feel of the club during use.

It is another object of the present invention to provide a variable-balanced club head which delivers a longer delayed impact thrust then prior known club heads.

It is yet another object of the present invention to provide a variable-balanced club head with a gravity point which is lower and further from the faceplate than prior known club heads.

It is an advantage of the present invention that the present club heads can be adjusted in weight and weight distribution by anyone with a minimum amount of training, effort and time and without removing the soleplate or faceplate of the head.

These and other objects and advantages of the present invention will be apparent to those skilled in the art in view of the present description including the drawing, in which.

The novel golf club heads of the present invention are based upon a novel weighting and balancing principle which I have discovered to adapt the head to be custom suited to the user by the user himself with a minimum of training, time and effort. The invention is based upon the discovery that variable weights in a wooden golf club head produce the greatest reslts when the following specifications and adhered to, such specifications being contrary to those followed in the designing of prior known golf club heads. First, the variable weights must be below and behind the core of the wooden head, the core being defined as the center point of the mass of the wood head. Second, the variable weights must be positioned parallel to and equidistant from the central vertical axis of the wood head, at least one on each side thereof for balance adjustment. Third, the means for varying the weights must permit ease of operation, possibility of varying one weight independently of the other, and possibility of making gradual but specifically known weight adjustments until the desired feed and performance is produced by the user by trial and error techniques.

Figure 1:
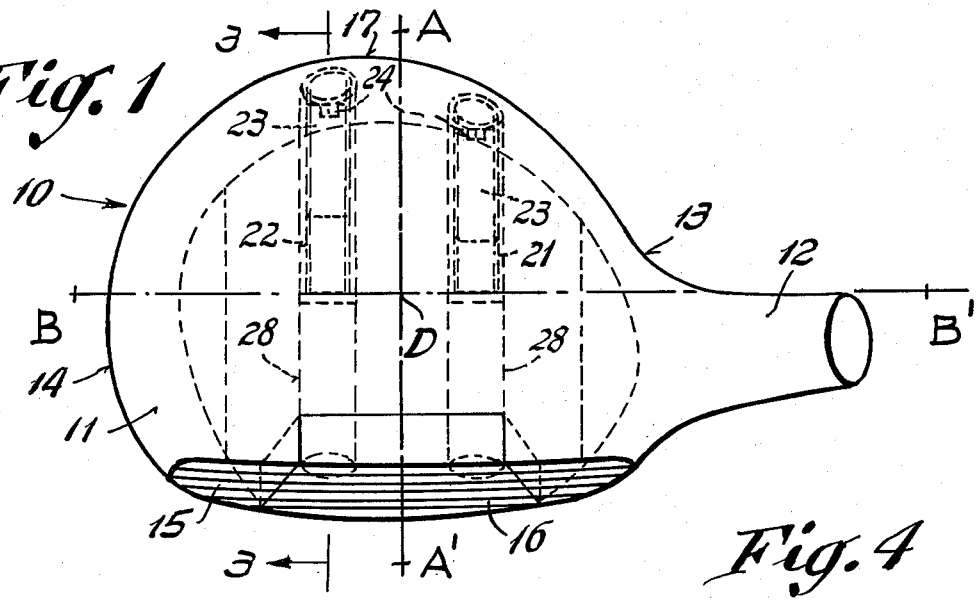
FIG. 1 is a plan view of a golf club head according to an embodiment of the present invention.
Figure 2:
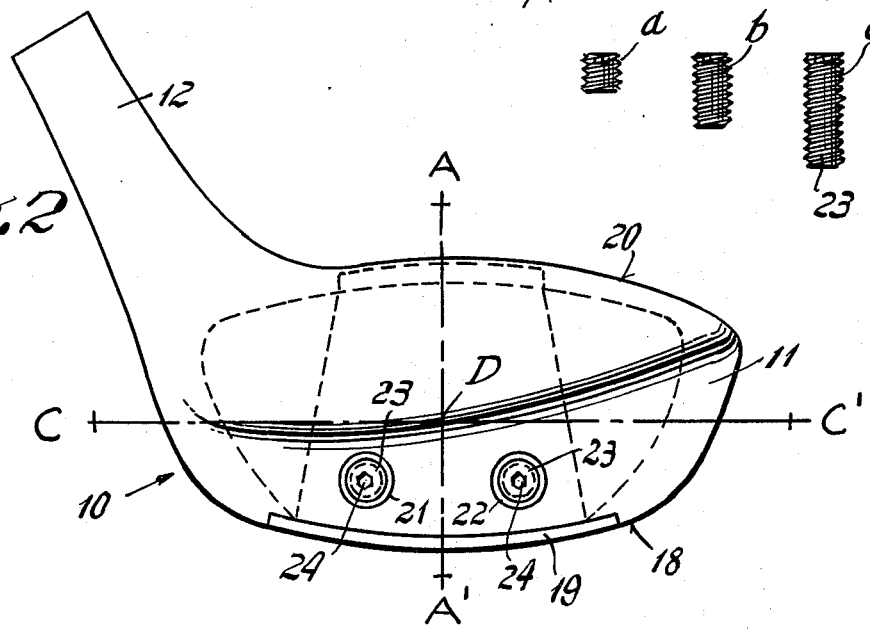
FIG. 2 is a rear view of the golf club head of FIG. 1.

Referring to the drawing, the wooden golf club heads 10 according to one embodiment of this invention comprise a wooden body 11 having a stem or hasel 12 at the heel section 13, a toe section 14 and a face section 15 having mounted therein a faceplate 16, a rear section 17, all shown in FIG. 1. As shown by FIG. 2, the head 10 also has a base or sole section 18 having mounted therein a soleplate 19, and a top or upper section 20. In all these respects, the present wooden club heads are identical to known wooden club heads. However the novel variable weighting means and the position thereof illustrated by the drawing represent a substantial departure from and improvement over known structures.

Figure 3:
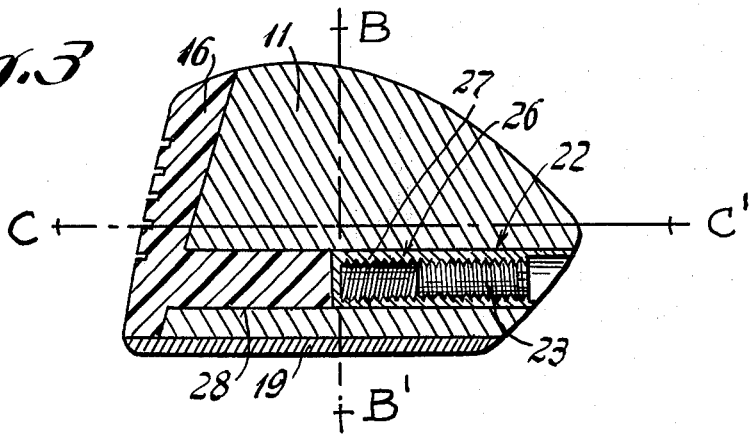
FIG. 3 is a vertical cross-section of the gold club head of FIG. 1 taken along the line 3—3.

The variable weighting means of the present invention comprise hollow tubular chambers 21 and 22 which are parallel to each other and to the central vertical axis A–A′ of the wooden body 11 which intersects the core D, as illustrated by FIGS. 1 and 3, the interior location of chambers 21 and 22 being illustrated by broken lines in FIG. 1. Chambers 21 and 22 open to the rear section 17 of the wooden body 11 and are provided with threaded weighted closure means or covers 23 which threadably engage the interior walls of the chambers and are provided with exposed key means 24 which as slots or hexagonal recesses for engagement with a screw driver or hexagonal wrench to remove or tighten them on the chambers.

The drawing illustrates the critical positioning of the weighting chambers relative to each other and relative to the faceplate 16 by means of axis lines. Axis line A–A′ is the central vertical axis plane which intersects core D and the center of the faceplate, and divides the wooden body 11 into the toe half and the heel half. Axis line B–B′ is the transverse vertical axis plane which also intersects core D, is perpendicular to line A–A′, and divides the wooden body 11 into the face half and the rear half. Axis line C–C′ is the central horizontal axis plane which also intersects core D, is perpendicular to lines A–A′ and B–B′, and divides the wooden body 11 into the sole half and the top or upper half. Thus the drawing clearly illustrates that the chambers 21 and 22 are both located in what might be termed the rear sole quadrant sections of the wooden body 11, below the core D, equispaced from and parallel to the central vertical axis A–A′, perpendicular to and positioned rearward of the transverse vertical axis B–B′ and parallel to but positioned below the central horizontal axis C–C′.

According to a preferred embodiment, as illustrated by the drawing, the hollow tubular chambers 21 and 22 comprise self-contained capsules which are cemented in place within holes bored into or through the wooden body 11. Referring to FIG. 3 which illustrates a cross-sectional view of the chamber 22, the chamber comprises a self-contained cylindrical capsule 26, such as of aluminum, having a walled body 27, the interior surface of which is threaded and is engaged by a threaded weighted closure means 23 adapted to be screwed into the capsule beyond the smooth surface of the wooden body 11. The capsule may be from about ¾ inch to 2 inches in length and have a diameter of from ¼ inch to ½ inch, depending upon the size of the wooden body. A preferred size is 1¼ inch long and ⅜ inch in diameter. If desired, the open end of the capsule may extend beyond the surface of the wooden body 11 and may be sanded smooth therewith for finished appearance.

FIG. 3 also illustrates a preferred means for positioning and cementing the capsule 26 in place, it being understood that the disclosure relating to capsule 26 also applies to an identical capsule which is positioned as chamber 22 on the opposite side of axis A–A′. As shown by FIGS. 2 and 3, the wooden body 11 is provided with hollow tubular cylindrical bores 28 which pass through the wooden body 11 from the face section 15 to the rear section 17, parallel to axis planes A–A′ and B–B′, are coaxial with the desired position of the capsule 26 and have a diameter slightly greater than that of the capsule so that the latter can be fitted therein, positioned as indicated and cemented. Thereafter the cores 28 can be filled with plastic which may be conveniently be a high impact resin such as an epoxy or polyurethane resin used to fill the bores and simultaneously form the faceplate integral therewith as shown by FIG. 3. The resin also tends to flow into any space between the capsule 26 and the bore 28 to insure motion-preventing bonding therebetween.

Obviously the threaded chambers or capsules adapted to receive the threaded closure means may have any desired shape so long as they are tubular so as to extend parallel to axis A–A′ and perpendicular to axis B–B′ whereby the weight therein is centered in a direction parallel to the swing of the club and to the flight of the ball. Any deviation from the parallel position of the chambers 21 and 22 interferes with the feel of the club during the swing and reduces or spreads the impact thrust of the head against the ball. Any deviation from the rearward and soleward location of the chambers 21 and 22 also interferes with the feel of the club during the swing and destroys the balance of the head during the swing whereby it is front-heavy and dips into the ball with a downward thrust rather than having rear balance as afforded by the present invention, which rear balance keeps the head level through a smooth-feeling swing and directs the momentum of the club weight parallel to the swing and in direct line beneath the point of impact between the faceplate and the ball and balanced on each side thereof. This low, balanced momentum causes the club head to follow through the ball in the path of the circular swing, imparting greater lift and distance to the ball than otherwise possible. Furthermore, the rearward location of the weights imparts a delayed impact thrust to the ball whereby the ball remains in contact with the club for a longer period of time, which, though minute, greatly increases the effect of the momentum with respect to distance.

As for accuracy, the positioning of the weight chambers on opposite sides of the central vertical axis A–A′ of the head provides a balance which can be modified by the user to compensate for his own tendency to hook or to slice the ball during play. The tendency to hook the ball can be compensated for by selecting the next heavier weighted closure means 23 and substituting it for the lighter closure means present in chamber 21 on the heel side of the head or conversely by using the next lighter closure means 23 in chamber 22 on the toe side of the head to produce the balance required for the individual to overcome the problem. The process is reversed if the individual has a tendency to slice the ball during play. As for distance, gradually heavier identical closure means are used on both chambers until the individual finds the weight at which he obtains greatest possible distance in his shot while retaining the required balance and accuracy.

Figure 4:
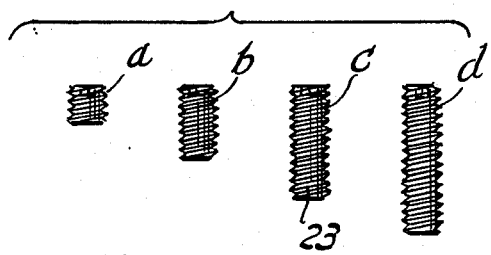
FIG. 4 is a perspective view of a group of weighted closure means having different known weights and adapted for use in the gold club head of FIGS. 1 to 3.

FIG. 4 illustrates four members of a series of unitary graduated weighted closure means *a*, *b*, *c* and *d*, each of which has a specific and accurate known weight from the lightest *a* through the heaviest *d* and each of which is supplied in duplicate for use as matched pairs in case where the balance of the club is satisfactory and only the swing weight is to be increased or decreased.

The number of matched pairs of graduated weighted closure means to be used in connection with the present clubs depends upon the number of swing weights to which each club is to be convertible. A difference in swing weight is represented by a single gram and therefore each individual closure means 23, such as *b* of FIG. 4, is ½ gram heavier than the next lighter closure means, such as *a* of FIG. 4, and ½ gram lighter than the next heavier closure means, such as *c* of FIG. 4, whereby the substitution of any pair of closure means for a pair of the next heavier or next lighter closure means represents a total increase or decrease in weight of 1 gram and a change of one swingweight upwards or downwards respectively.

The lightest closure means 23, such as *a* of FIG. 4, has a weight of ½ gram. A preferred number of pairs of weighted closure means 23 to be supplied with each club is seven pairs, but it should be understood that fewer pairs or substantially more pairs can be supplied and used depending upon the number of swingweights desired. A larger number of weighted closure means can be accommodated by increasing the diameter of the weight chambers or capsules to accommodate weights which are more narrow, and/or by using weighted covers based upon heavier metals so that a difference of ½ gram in weight does not represent a substantial difference in size.

Preferably the weighted closure means 23 of the present invention are numbered, color-coded or otherwise marked to indicate the weight of each cover so that the user can make necessary substitutions with ease and accuracy. This represents a substantial improvement over the use of metal powder, shot or other materials which do not have predetermined known weights and are used on a trial and error basis and do not permit the user to adjust accurately from one swingweight to another. Since the present weighted closure means or cover is the only present in the weight chambers or capsules, and since the specific weight thereof is known, the alteration of the swingweight and balance of the present club heads can be controlled within very close and accurate limits by the user.

As illustrated by the drawing, the present weight chambers or capsules preferably have a full interior thread along their entire depth and the weighted closure means or covers preferably have a full exterior thread in order to simplify their manufacture. The weighted covers preferably are screwed into each chamber or capsule only a sufficient distance that they do not protrude, whereby they are present as covers adjacent the entrance of the chambers or capsules, as illustrated by FIG. 3 of the drawing. It has been found that the inserted weighted covers do not loosen or move in the club head during use and therefore it has not been found necessary to use a stop means, such as a flanged head on the covers, to secure the weighted covers within the chambers or capsules. However such stop means can be used, if desired, to fix the positioning and securing of the weighted covers adjacent the entrance of the chambers or capsules.

Variations and modifications may be made within the scope of the claims and portions of the improvements may be used without others.

I claim:

1. Wooden head for a golf club comprising a wooden body having a core comprising its center of gravity, heel and toe sections on opposite sides of said core a hosel located at said heel section, said feel out toe section being separated by a central vertical axis plane which intersects said core, face and rear sections on opposite sides of said core and separated by a transverse vertical axis plane which intersects said core at an angle perpendicular to said central axis and rearwardly of said hosel sole and upper sections below and above said core and separated by a horizontal axis plane which intersects said core, and at least two hollow threaded tubular chambers in said wooden body each of which is adapted to receive and threadably engage a unitary weighted closure means selected from a group of graduated, threaded weighted closure means each having a distinct known weight as the sole weight in said chambers, an equal number of said tubular chambers being located within said wooden body on opposite sides of said central vertical axis plane in said heel and toe sections, extending from said rear surface to said transverse vertical axis plane in said rear section behind and beneath said core and horizontal axis plane in said sole section and spaced from the under surface of said sole section, said tubular chambers extending parallel to each other and to the central vertical and horizontal axis planes and having their weighted closure means exposed and removable through openings in the rear surface of the wooden body, one of said weighted closure means of different known weight being threadably engaged within each of said tubular chambers to provide the desired, variable balance and swing weight of said wooden head while also providing variable delayed impact thrust to the ball being hit and variable increased lift and distance thereto.

2. Wooden head for a golf club according to claim 1 in which said hollow tubular chambers comprise self-contained capsules comprising hollow tubular walled elements, the interior walls of which are threaded for engagement with any one of said unitary threaded weighted closure means, said capsules being cemented in position within said wooden body.

3. Wooden head for a golf club according to claim 1 in which said group of weighted closure means is graduated in about one-half gram increments whereby each matched pair of said closure means weighs about one gram more than the next lighter matched pair of closure means.

4. Process for producing a wooden head for a golf club comprising a wooden body having a core comprising of said core, a hosel located at said heel section, said heel and toe section being separated by a central vertical axis plane which intersects said core, face and rear sections on opposite sides of said core and separated by a transverse vertical axis plane which intersects said core at an angle perpendicular to said central axis and rearwardly of said hosel sole and upper sections below and above said core and separated by a horizontal axis plane which intersects said core, comprising the steps of boring an equal number of hollow tubular openings from the surface of said rear section to the transverse vertical axis plane in each of the heel and toe sections of said wooden body at the rear section thereof, on opposite sides of said vertical axis plane, behind and beneath said core and horizontal axis plane in said sole section and spaced from the under surface of said sole section and parallel to each other and to the central vertical and horizontal axis planes of said wooden body, providing said openings with thread means to form threaded chambers adapted to receive and threadably engage a unitary, weighted closure means selected from a group of graduated, threaded weighted closure means each having a distinct known weight as the sole weight in said chambers, said threadably engaging one of said weighted closure means of different known weight within each of said tubular chambers to provide the desired, variable balance and swing weight of said wooden head while also providing delayed impact thrust to the ball being hit and increased lift and distance thereto.

5. Process according to claim 4 which comprises inserting threaded self-contained tubular walled elements into said tubular openings and cementing said elements in position to form said chambers adapted to receive said unitary threaded closure means.

6. Process according to claim 4 which comprises varying the swing weight of the club head by substituting graduated closure means which differ in weight by a total of about one gram for the closure means present within said chambers.

* * * * *

UNITED STATES PATENT AND TRADEMARK OFFICE

CERTIFICATE OF CORRECTION

PATENT NO. : 3,979,123

DATED : September 7, 1976

INVENTOR(S) : PETER A. BELMONT

It is certified that error appears in the above-identified patent and that said Letters Patent are hereby corrected as shown below:

Col. 1, line 61, delete "gold" and substitute --golf--;

Col. 1, line 65, delete "gold" and substitute --golf--;

Col. 2, line 4, delete "reslts" and substitute --results--;

Col. 2, line 5, delete "and" and substitute --are--;

Col. 2, line 22, delete "hasel" and substitute --hosel--;

Col. 2, line 45, delete "which" and substitute --such--;

Col. 3, line 32, delete "cores" and substitute --bores--;

Col. 3, line 33, delete "be" first occurrence;

Col. 4, line 23, delete "case" and substitute --cases--;

Col. 4, line 63, after "only" insert --weight--;

Claim 1, line 3, after "core" insert a comma (,);

Claim 1, line 4, delete "feel out" and substitute --heel and--;

Claim 1, line 10, after "hosel" insert a comma (,);

Claim 4, lines 2 and 3, after "comprising" insert --its center of gravity, heel and toe sections on opposite sides--;

Claim 4, line 9, after "sole" insert a comma (,);

Claim 4, line 26, delete "said" second occurrence and substitute --and--.

Signed and Sealed this

Seventh Day of December 1976

[SEAL]

*Attest:*

RUTH C. MASON
*Attesting Officer*

C. MARSHALL DANN
*Commissioner of Patents and Trademarks*